US006694779B1

(12) United States Patent
Dreger

(10) Patent No.: US 6,694,779 B1
(45) Date of Patent: Feb. 24, 2004

(54) NAPKIN RING WITH INTERCHANGEABLE ORNAMENT

(76) Inventor: Youwanda Deloris Dreger, 16200 Maya Way, Los Gatos, CA (US) 95030

( * ) Notice: Subject to any disclaimer, the term of this patent is extended or adjusted under 35 U.S.C. 154(b) by 0 days.

(21) Appl. No.: 10/186,374

(22) Filed: Jun. 27, 2002

Related U.S. Application Data

(60) Provisional application No. 60/302,952, filed on Jul. 3, 2001.

(51) Int. Cl.[7] ..... A44C 25/00

(52) U.S. Cl. ..... 63/33; 63/15; 63/29.2; 63/900; D7/633; D7/634

(58) Field of Search ..... 63/15, 29.2, 900, 63/33; D7/633, 634

(56) References Cited

U.S. PATENT DOCUMENTS

| | | | | | |
|---|---|---|---|---|---|
| 198,065 | A | | 12/1877 | Annin | |
| 345,164 | A | | 7/1886 | Monroe | |
| 1,286,610 | A | * | 12/1918 | Harriman | 224/217 |
| 1,855,066 | A | * | 4/1932 | Peters | 63/15 |
| D113,962 | S | * | 3/1939 | Brophy | D11/26 |
| 2,176,052 | A | * | 10/1939 | Beyer | 132/331 |
| 3,509,734 | A | * | 5/1970 | Lederer | 63/15 |
| D227,536 | S | * | 7/1973 | Berger | D7/99 |
| 3,835,664 | A | * | 9/1974 | Nesbit | 63/15.6 |
| 3,965,591 | A | | 6/1976 | Le Sueur | |
| D258,642 | S | * | 3/1981 | Bartkowski | D11/26 |
| 4,420,102 | A | * | 12/1983 | Clark | 223/34 |
| D273,261 | S | * | 4/1984 | Sun | D7/72 |
| 4,522,215 | A | | 6/1985 | Verducci | |
| 5,014,400 | A | | 5/1991 | Ban | |
| 5,156,023 | A | | 10/1992 | Bevolo | |
| D356,235 | S | * | 3/1995 | Yee | D7/633 |
| 5,487,924 | A | | 1/1996 | Fritze | |
| 5,588,310 | A | | 12/1996 | Lai | |
| D380,418 | S | | 7/1997 | Michael | |
| 5,806,346 | A | * | 9/1998 | Schlinger et al. | 63/40 |
| 6,079,224 | A | | 6/2000 | Schehr | |
| D451,424 | S | * | 12/2001 | Ambar | D11/34 |

* cited by examiner

*Primary Examiner*—Andrea Chop
(74) *Attorney, Agent, or Firm*—Jack Lo

(57) ABSTRACT

A napkin ring is comprised of a loop with a first magnetic material embedded in a top end. First alignment members are arranged around the first magnetic material. A detachable ornament has a second magnetic material attached to a base thereof for mating with the first magnetic material on the loop. Second alignment members are arranged on the bottom of the ornament around the second magnetic material. The second alignment members are arranged to mate with the first alignment members when the ornament is attached to the loop for maintaining the alignment of the ornament on the loop. A flat surface is provided on a bottom end of the loop for preventing the loop from rolling on a table to position the ornament facing up.

1 Claim, 2 Drawing Sheets

NAPKIN RING WITH INTERCHANGEABLE ORNAMENT

CROSS REFERENCE TO RELATED APPLICATIONS

I claim the benefit of provisional application No. 60/302,952 filed on Jul. 3, 2001.

BACKGROUND OF THE INVENTION

1. Field of the Invention

The invention broadly relates to napkin rings.

2. Prior Art

A napkin ring is a device for securing a napkin in a folded condition. A typical napkin ring is comprised of a circular loop. Some napkin rings include ornaments fixedly attached to the loops. People tend to purchase napkin rings with different ornaments for different occasions. However, ornamented napkin rings are more expensive to make and bulky to store. They are also difficult to position with the ornaments at the top because they tend to roll about on the circular loops.

U.S. Pat. No. 198,065 to Annin discloses a napkin ring comprised of a loop with a fixedly attached name plate. U.S. Pat. No. 345,164 to Monroe discloses a napkin ring with a recessed ornamental band. U.S. Pat. No. 3,965,591 to Le Sueur discloses a napkin ring with a name plate secured inside a slot by a magnetic material. U.S. Pat. No. 5,487,924 to Fritze discloses a napkin ring made of a folded sheet. All the prior art napkin rings include circular loops that tend to roll about and make positioning the ornament at the top rather difficult.

BRIEF SUMMARY OF THE INVENTION

Accordingly, an object of the present napkin ring is to attach an interchangeable ornament on a loop for reducing the cost and bulk of a napkin ring collection.

Another object of the napkin ring is to securely align the ornament on the loop, and still allow the ornament to be easily attached and removed.

Another object of the napkin ring is to stably position the ornament facing up on a table by preventing the loop from rolling.

The present napkin ring is comprised of a loop with a first magnetic material embedded in a top end. First alignment members are arranged around the first magnetic material. A detachable ornament has a second magnetic material attached to a base thereof for mating with the first magnetic material on the loop. Second alignment members are arranged on the bottom of the ornament around the second magnetic material. The second alignment members are arranged to mate with the first alignment members when the ornament is attached to the loop for maintaining the alignment of the ornament on the loop. A flat surface is provided on a bottom end of the loop for preventing the loop from rolling on a table to position the ornament facing up.

DRAWING REFERENCE NUMERALS

10. Loop
11. Hole
12. First Magnetic Material
13. First Alignment Member
14. Flat Surface
15. Ornament
16. Second Magnetic Material
17. Base
18. Rim
19. Second Alignment Member
20. Napkin

DETAILED DESCRIPTION OF THE INVENTION

Figure 1:
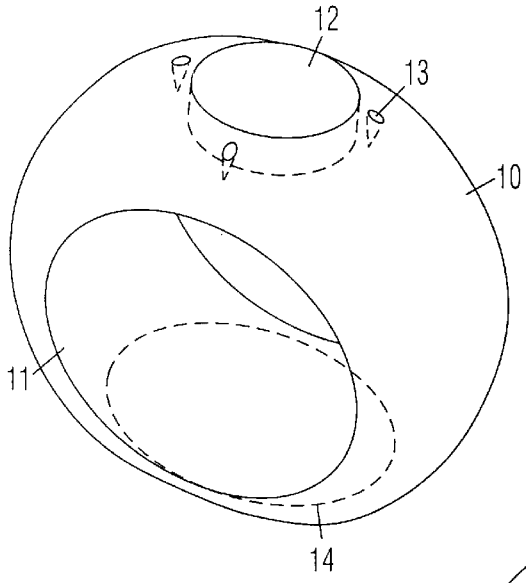
FIG. 1 is a top perspective view of the napkin ring.
Figure 2:
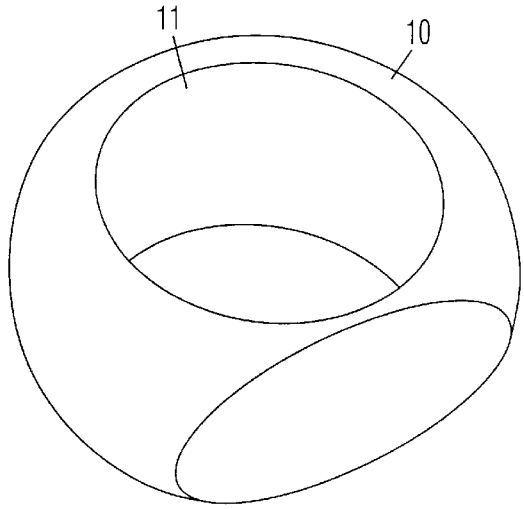
FIG. 2 is a bottom perspective view thereof.
Figure 3:
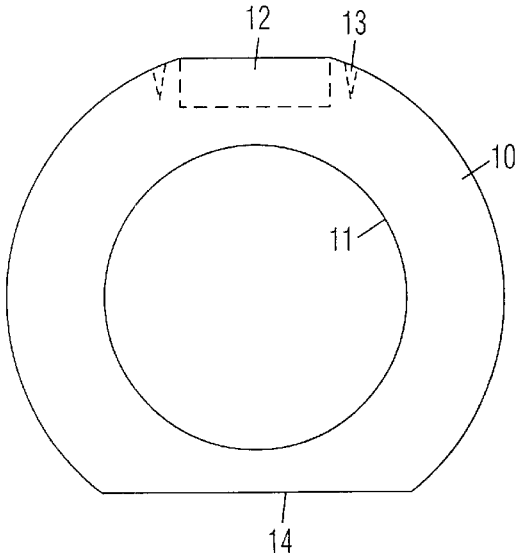
FIG. 3 is a side view thereof.
Figure 4:
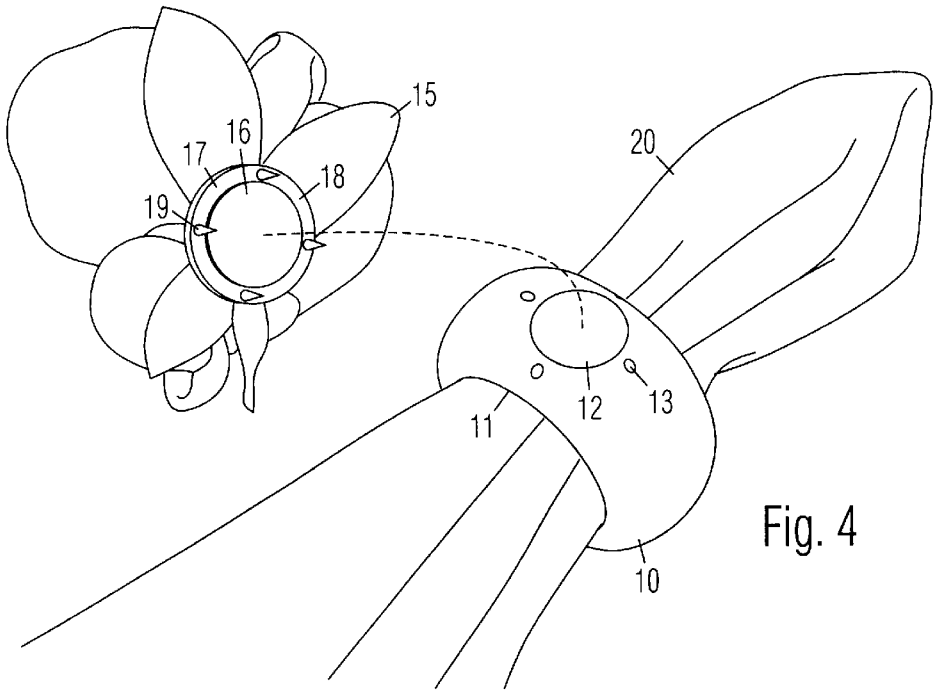
FIG. 4 is a top perspective view thereof securing a napkin and with an ornament detached.

FIGS. 1–3:

A preferred embodiment of the present napkin ring is shown in a top perspective view in FIG. 1, a bottom perspective view in FIG. 2, and a side view in FIG. 3. It is comprised of a generally circular loop 10 with a center hole 11. Loop 10 may be made of any suitable material, such as wood, plastic, metal, rubber, stone, glass, etc. A first magnetic material 12 is embedded in a top end of loop 10. First magnetic material 12 has a flat outer surface which is preferably flush with the surface of loop 10 for being inconspicuous. First magnetic material 12 may be a magnet or a material which is attracted by a magnet, such as a ferrous metal. First alignment members 13 are arranged around first magnetic material 12. First alignment members 12 are shown as tapered holes in this example, but they may be holes of another shape, or they may be projecting members. There may be any number of first alignment members 13. A flat surface 14 is provided on a bottom end of loop 10 for preventing the napkin ring from rolling on a table.

FIGS. 4–5:

As shown in FIG. 3, a detachable ornament 15 is provided for connecting to loop 10. Ornament 15 is a flower in this example, but it may be of any other shape or size. Ornament 15 has a second magnetic material 16 attached to a base 17 for mating with first magnetic material 12 on loop 10. Second magnetic material 16 preferably has a flat outer surface. Second magnetic material 16 may be a magnet or a material which is attracted by a magnet, such as a ferrous metal. Either first or second magnetic material 12 or 16 must be a magnet, and the other may be either a magnet or a material which is attracted by a magnet. Base 17 is slightly wider than second magnetic material 16 to define a rim 18. Second alignment members 19 are arranged around rim 18 for mating with first alignment members 13 on loop 10 when ornament 15 is attached to loop 10, so as to maintain alignment of ornament 15 on loop 10. Second alignment members 19 are shown as tapered pins in this example, but they may be of another shape, and may be recessed members if first alignment members are projecting members. There may be any number of second alignment members 19 as long as they are arranged to mate with first alignment members. A napkin 20 is shown positioned through hole 11 in loop 10.

Figure 5:
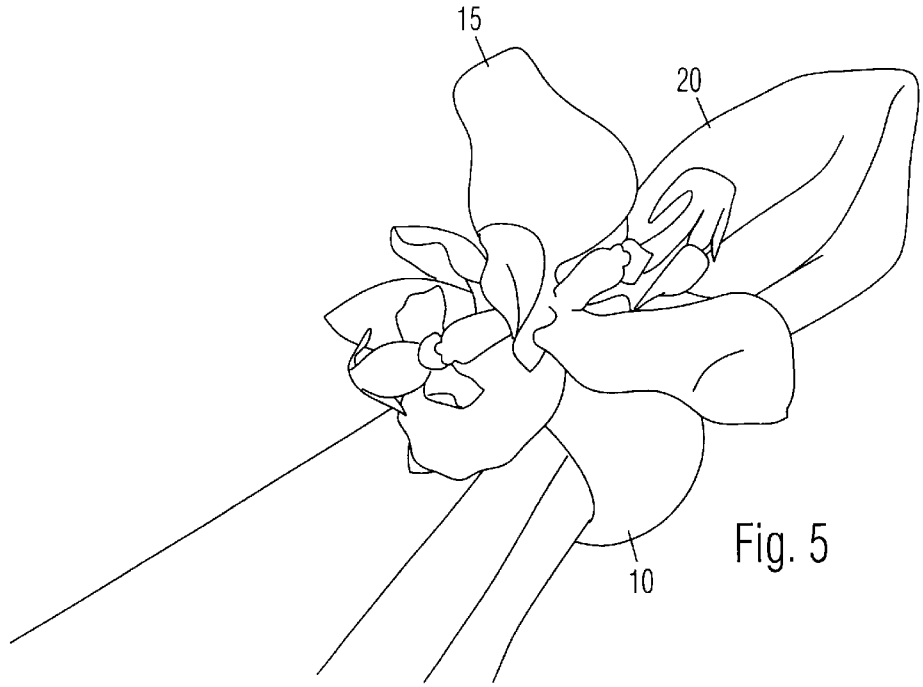
FIG. 5 is a top perspective view thereof with the ornament attached.

Ornament 15 is shown attached to loop 10 in FIG. 5. When ornament 15 is attached to loop 10, flat surface 14 (FIG. 1) is positioned against the table for preventing the napkin ring from rolling so as to maintain ornament 15 facing up.

Additional ornaments (not shown) of different shapes may be provided for interchangeably attaching to loop 10, which eliminates duplication of loops for saving cost and storage space.

Although the foregoing description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A napkin ring apparatus, comprising:

a generally circular loop with a central hole for surrounding a folded napkin positioned through said central hole of said loop;

a first magnetic material embedded in a top end of said loop;

first alignment members arranged around said first magnetic material;

a flat surface on a bottom end of said loop for stably engaging a table and preventing said napkin ring from rolling;

a detachable ornament;

a second magnetic material on a base of said ornament and arranged to releasably mate with said first magnetic material on said loop; and second alignment members on said base of said ornament arranged to engage said first alignment members on said loop to maintain said ornament in alignment on said loop;

wherein said base is wider than said second magnetic material to define a rim around said second magnetic material, and said second alignment members are arranged on said rim.

* * * * *